US007056225B1

(12) United States Patent
Pipkin

(10) Patent No.: US 7,056,225 B1
(45) Date of Patent: Jun. 6, 2006

(54) METHOD OF MAKING A SINGLE FLEX MATCHED SET OF GOLF CLUBS

(76) Inventor: Eldon R. Pipkin, 23025 N. 15th Ave., #105, Phoenix, AZ (US) 85027

( * ) Notice: Subject to any disclaimer, the term of this patent is extended or adjusted under 35 U.S.C. 154(b) by 0 days.

(21) Appl. No.: 10/947,084

(22) Filed: Sep. 21, 2004

Related U.S. Application Data

(63) Continuation of application No. 10/198,826, filed on Jul. 18, 2002, now abandoned.

(51) Int. Cl.

| | |
|---|---|
| ***A63B 53/10*** | (2006.01) |
| ***A63B 53/12*** | (2006.01) |
| ***A63B 53/00*** | (2006.01) |
| ***A63B 57/00*** | (2006.01) |

(52) U.S. Cl. ..... 473/289; 473/409

(58) Field of Classification Search ..... 473/289, 473/409

See application file for complete search history.

(56) References Cited

U.S. PATENT DOCUMENTS

| | | | | |
|---|---|---|---|---|
| 4,122,593 | A * | 10/1978 | Braly | 29/407.07 |
| 4,958,834 | A * | 9/1990 | Colbert | 473/289 |
| 5,722,899 | A * | 3/1998 | Cheng | 473/289 |
| 5,879,241 | A * | 3/1999 | Cook et al. | 473/289 |
| 6,572,488 | B1 * | 6/2003 | Weiss et al. | 473/289 |

FOREIGN PATENT DOCUMENTS

| | | | |
|---|---|---|---|
| CA | 2185978 | * | 9/1996 |

* cited by examiner

*Primary Examiner*—Stephen Blau
(74) *Attorney, Agent, or Firm*—Gregory J. Nelson

(57) ABSTRACT

A golf club matching method in which the ideal shaft stiffness for a particular golfer is first empirically determined using calibrated test clubs. The shafts are incrementally trimmed to result in a set in which each club has the same or ideal shaft frequency or stiffness. The manufacturing method may be automated using a computer controlled cutting operation to fabricate a number of matched club shaft blanks by inputting information relative to the desired stiffness, shaft blank characteristics, club head, grip, finished club length and other data.

5 Claims, 5 Drawing Sheets

| SHAFT ANALYZER READOUT CONVERSION TABLE | |
|---|---|
| 335 - 7X | 300 - MEN'S STIFF |
| 330 - 6X | 295 - MEN'S FIRM |
| 325 - 5X | 290 - MEN'S REGULAR |
| 320 - 4X | 285 - SENIOR STIFF |
| 315 - 3X | 280 - SENIOR REGULAR |
| 310 - 2X | 275 - LADIES STIFF |
| 305 - 1X | 270 - LADIES REGULAR |

METHOD OF MAKING A SINGLE FLEX MATCHED SET OF GOLF CLUBS

CROSS REFERENCE IS MADE TO RELATED APPLICATION

This application is a continuation of application Ser. No. 10/198,826, filed Jul. 18, 2002 now abandoned, of the same title.

FIELD OF THE INVENTION

The present invention relates to a method for making a set of golf clubs, and more particularly relates to a fitting and fabrication method in which each club in the set is matched to the others so that all the clubs have the same vibration frequency. The matching technology is termed "single flex matching."

BACKGROUND OF THE INVENTION

Golf is a game that is played and enjoyed by individuals of all ages. Over the years, golf equipment has improved with the advent of improved materials and techniques. Advancements have been made in the design of golf clubs and the materials utilized in their construction. Golf clubs are designated as "woods" and "irons." Irons include clubs numbered 1 through the wedges. "Woods" is a term applied to drivers, two woods, three woods and so on, which may be fabricated from wood or, more recently, from more exotic materials such as titanium. The trend has been toward utilization of more sophisticated materials in the construction of golf club shafts such as graphite and use of materials such as titanium in the fabrication of golf club heads. The reason for these changes is to provide equipment which will enhance the performance of golfers. The wood clubs typically have longer shafts ranging from 43" to 47" in length whereas the irons have shorter shafts. Irons decrease in shaft length as the number of the iron increases. For example, a one iron will less loft and have a much longer shaft than a pitching wedge.

One approach to providing improved performance is to design clubs that provide the golfer consistent feel regardless of a particular club that is selected. The term "feel" is a highly subjective term, but certain physical characteristics of the club can be designed into a set of clubs to attempt to achieve uniformity of feel. Various characteristics which are selected include swing weight, flex and shaft stiffness. "Flex" is the common term given to the bending properties of a golf club. Flex is often identified by a letter, as for example "L" standing for ladies clubs, "A" for amateur, "R" for regular, "S" for stiff and "X" for extra stiff. The flex point of a shaft is the point of maximum bend when the shaft is bent. Shafts with a high kick point may feel more rigid than shafts with low kick points. Swing weight relates to the weight of the shaft. Swing weight measurement relates to overall weight of the club during the swing and 3 grams equals approximately one swing weight point.

When discussing shaft, "torque" refers to ability of shaft resist twisting force about its center line. A high torque rating means the club is low in resisting twist and is high in torsional twist or deflection. One particular characteristic is vibration frequency of the golf club shaft. Vibration frequency is typically defined as the oscillation of the shaft in cycles per minute (cpm) of shaft when it is secured at its butt end in a vice or clamp with the opposite end being free. The free end of the shaft is then manually deflected and released and the oscillation measured.

Many golfers have found a greater consistency in feel and control within a set of clubs is obtained when the vibration frequency are within a certain range.

U.S. Pat. No. 4,070,022 relates to a method of producing matched golf clubs which comprises the steps of determining under similar conditions the frequency of each golf club shaft of a plurality of shafts. Shafts are selected from the plurality such that the frequencies fall on a predetermined gradient line formed by a plot of shaft frequency of shaft length. Frequency increments between successive shaft lengths along a gradient line are substantially equal. The gradients are substantially straight line and increases as shaft length decreases and the frequency increments between successive shaft lengths along the gradient are substantially equal. This approach is representative of a number of golf club manufacturers and sometimes termed "flat line frequency" matching.

Other approaches to the production of a matched set of golf clubs can be found in U.S. Pat. No. 5,040,279. In this method, an electronic frequency analyzer measures the vibrational frequency of the shafts or clubs. Basically this patent deals with the problem of obtaining accurate frequency measurement for composite shafts which have non-uniform cross sections. The patentee suggests there exists certain chordal planes which will yield more consistent frequency measurements if the shaft is caused to oscillate in such plane.

U.S. Pat. No. 5,722,899 discloses methods of making a set of golf clubs that are matched according to vibration frequency. The method includes a random selection of shafts from a stock of raw shafts wherein the vibration frequency of each shaft is determined and then each shaft assigned a club head number. Conversion values are based on the desired actual club head weight for each shaft and by determining a value between a desired and measured frequency of each shaft, a total frequency conversion value may be obtained. The total frequency conversion value may then be used to determine an amount to trim each shaft and thereby linearly match each shaft to the set based on vibration frequency and an increase in club head number.

Thus, from the foregoing, it will be seen that the prior art suggest various golf club manufacturing techniques in which vibration frequency is used as a parameter in matching golf clubs. However, the prior art generally suggests that frequency be linearly matched so that as the club head number increases, the stiffness will decrease in a generally linear relationship. The result is that each club will have a different feel to the golfer.

BRIEF SUMMARY OF THE INVENTION

Briefly, the present invention provides a method of fabricating a set of golf clubs having shafts that are matched according to their vibration frequency, each having the same or closely similar characteristics. Each club will have a vibration frequency which is substantially the same as the other clubs. This method of matching golf club is termed "single flex matching." Thus, clubs are fitted so that each club in a set is matched to the golfer's ideal shaft frequency, sometimes termed "stiffness." Golfers using golf clubs manufactured and fitted in accordance with the present invention will experience improvement almost from the first swing without the golfer having to modify or make changes in his or her swing. In most all cases, the golfer will gain additional distance and experience better accuracy, softer feel and less shaft vibration. Clubs manufactured according to the present invention load and unload properly and uniformly during the golf swing.

The method includes first empirically determining the optimum shaft frequency or flex for a particular golfer. As mentioned above, shaft frequency varies considerably from ladies' regular through men's extra stiff clubs. Typically, these readings taken on a frequency analyzer would range from about 300 cpm to 335 cpm for a shaft rated seven times stiff. The appropriate stiffness for a particular golfer depends upon a number of factors including the ability and skill of the golfer, the physical size and characteristics of the individual golfer, normal club head speed and other factors. Therefore, to determine the optimum frequency, the golfer will first hit a number of golf balls with a calibrated test golf club having a selected frequency. Preferably, the range of test clubs used will include the 9, 7 and 5 irons with the golfer starting with the most lofted club, the 9 iron. The test clubs each have a predetermined vibration frequency. For example, the golfer may start with a selection of clubs having a stiffness in the range of 300 cpm which is generally considered a stiff shaft. A trained observer will observe the flight and path of the golf ball. From this visual observation, it is determined whether the club shaft having a selected vibration frequency is appropriate. Generally, if the shaft is too stiff, the golfer will tend to close the face and the ball will travel in more leftward flight path. If the shaft selected is too flexible, the golfer will tend to push the ball to the right. The ball flight path will also not assume the proper trajectory.

The golfer will then work in one direction of stiffness or the other using the calibrated test clubs until a club having a vibration frequency which is optimum for the particular golfer is determined. Once the proper shaft stiffness is determined, the golfer's clubs are equipped with the proper shaft. The golf clubs may be new clubs or may be an existing set in which the existing shafts are replaced.

The process of optimizing the golf clubs includes first selecting a club blank. Typically for a steel shaft, standard shaft blank come in 41" lengths. The club shaft is carefully trimmed an incremental amount at a time. The trimming can be from either the tip or butt end of the club. This is in contrast to conventional mass manufacture operations which will generally trim only one end until the desired shaft length is reached for the particular club without regard to the effect on stiffness.

The trimming operation is continued until the desired stiffness is achieved. The stiffness is measured throughout the trimming process by using a conventional frequency analyzer. During measurement after each trimming operation, the desired club head, as for example a 7 iron head, is placed on the club when the frequency measurements are made. The spine of the club shaft is also located and marked for later assembly. This is done by observing the path of the shaft end as it vibrates. Testing should be done in a manner that the vibrations are generally planar and not oscillatory. The club is rotated and reclamped in the analyzer if necessary.

Once the desired frequency characteristics have been obtained, the club can then be assembled by securing the head and grip in place on the shaft. Generally small allowances are made during the trimming operation to insure the completed club will have the appropriate frequency. For example, generally the procedure accommodates small variations, as for example 2 or 3 cpm below the desired level, to accommodate hosel insertion depth in the club head.

The above describes a manual approach to fitting and fabricating clubs having single flex matched frequency characteristics. The present invention also lends itself to mass manufacture or automated manufacture using this method. Once a desired shaft stiffness has been selected, a number of identical shafts may be automatically manufactured using this method. With the automated system, a club shaft trim line is established having a computer-controlled cutting head which can trim a shaft either from the butt or tip end. The cutting head is controlled by a computer which has been programmed with appropriate information concerning the characteristics of the club shaft, the characteristics of particular golf club head to be attached and the characteristics of the grip. The operator will input the information concerning a club or clubs to be manufactured, including the identification of the club as for example 7 iron, the length of shaft desired and the desired frequency characteristics. Once this information is entered into the computer, the computer will automatically determine where the appropriate cuts are to be made and the automated sawing operation will perform these operations as the shafts are passed through the work area. This can be done either for a single club or can be done on a mass production basis where the manufacturer may wish to manufacture a number of sets of clubs having predetermined characteristics as for example having a vibration frequency of 300 cpm.

BRIEF DESCRIPTION OF THE DRAWINGS

The above and other objects and advantages of the present invention will be more apparent from the following description, claims and drawings in which:

DETAILED DESCRIPTION OF THE DRAWINGS

The following description describes a method for the manufacture or fabrication of a matched set of golf clubs in which the vibration frequency of each golf club in the set is essentially the same as every other golf club in the set. The present invention applies to golf club shafts of various materials. It is well known that shafts may be steel or may be various composite materials, such as graphite, and it is to be understood the term "shaft" applies to shafts of various materials and configuration.

Typically, shafts taper from a relatively larger butt end to a tip end. A conventional set of clubs includes "woods" (which may be made of wood or metal) generally numbered 1, 2 and 3. A legal set of golf clubs contains 14 clubs and most players will carry a pitching wedge, sand wedge, a putter and selected irons between numbers 1 to 9 to fill out the set.

Figure 1:
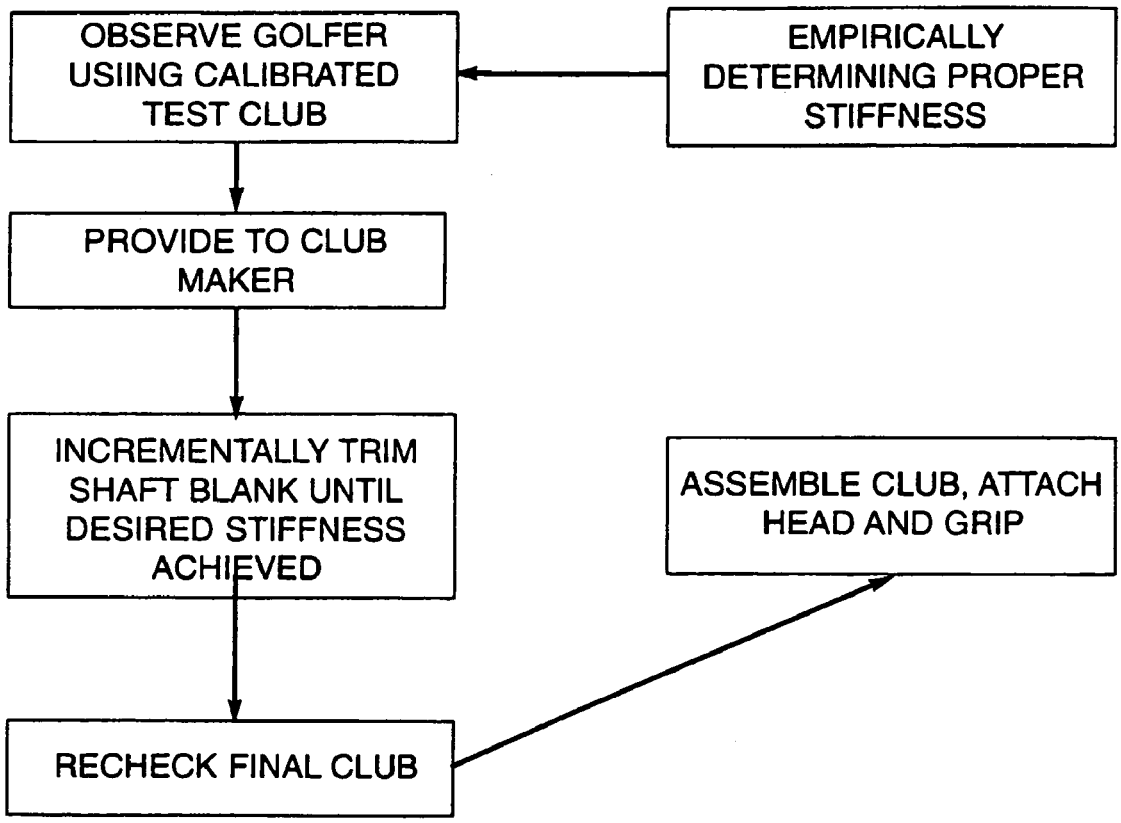
FIG. 1 is a schematic diagram illustrating the empirical club fitting procedure and the method of making a set of golf clubs that are matched according to vibration frequency.
Figures 4, 4A:
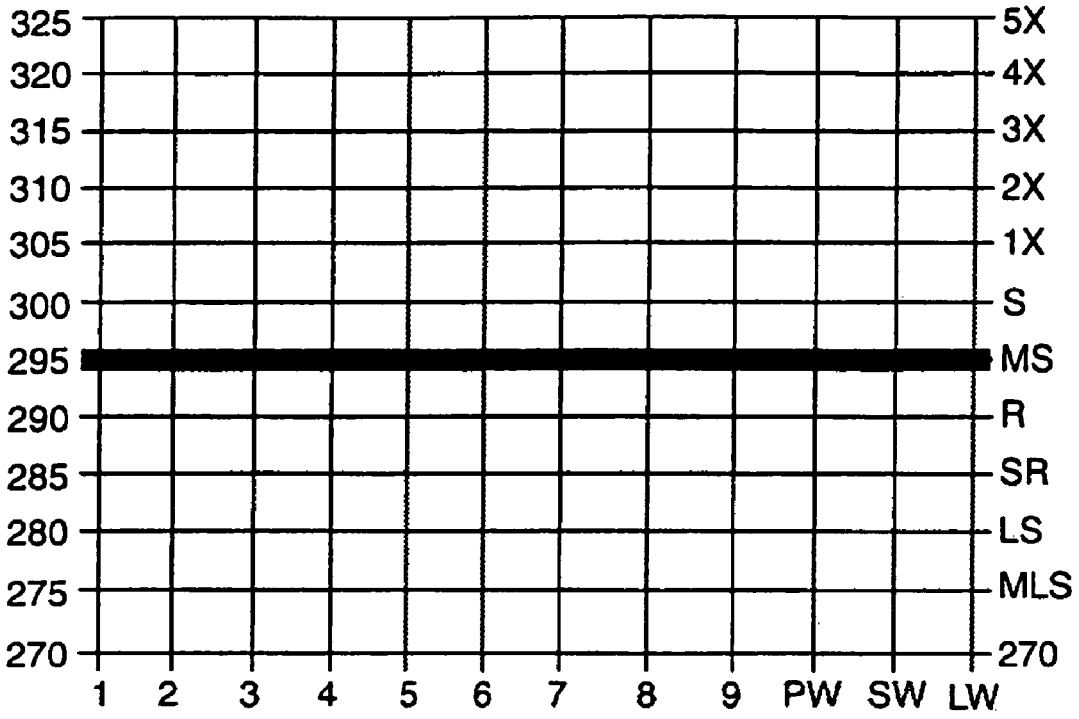
FIG. 4 is a chart illustrating the stiffness of a representative set of golf clubs having matching or single flex shaft stiffness according to the invention.
FIG. 4A is a shaft analyzer conversion table.
Figure 5:
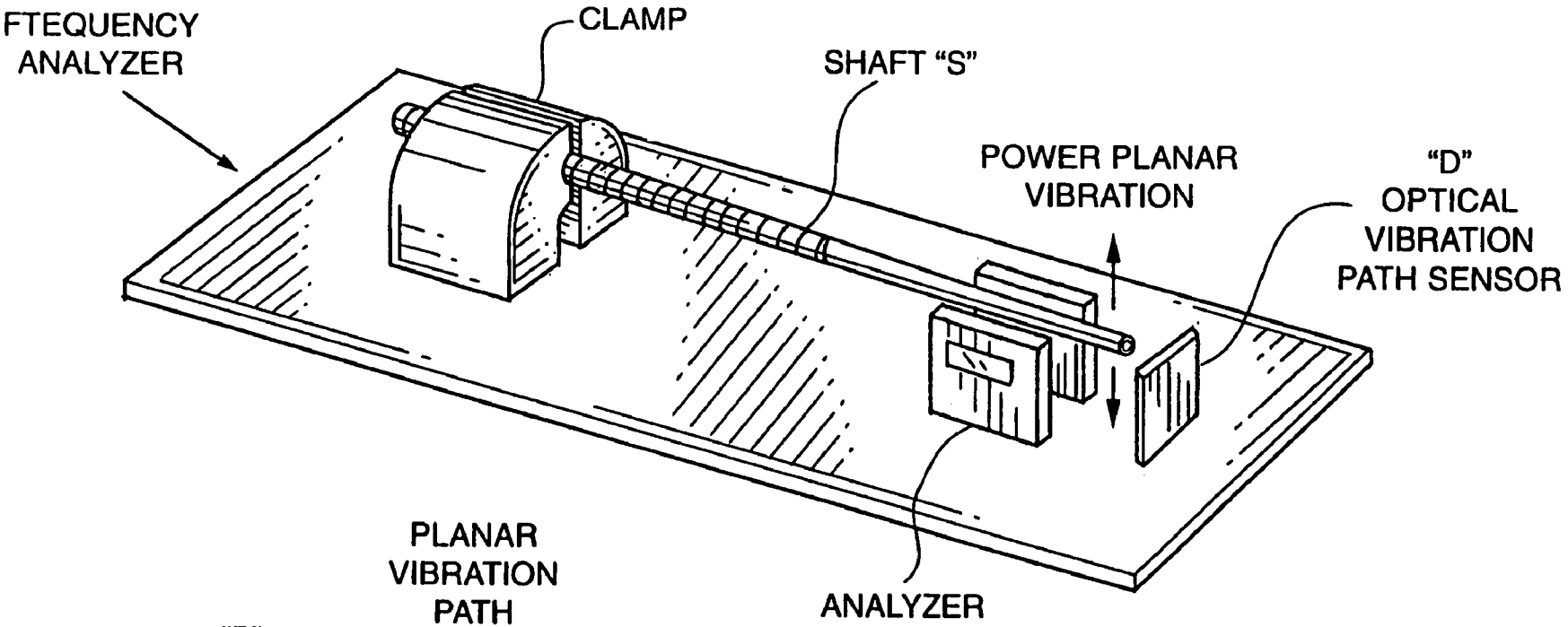
FIG. 5 illustrates the determination of frequency vibration using a frequency analyzer.

The club shaft matching process is shown in FIG. 1. The first step in the process is to empirically determine the optimum vibration frequency for a particular golfer. Standard golf shafts range from a ladies' regular to men's stiff and, on a conventional frequency vibration analyzer, will provide readings of between approximately 270 to approximately 335 cpm for stiffness as seen in FIG. 4A. Frequencies are measured by known methods which involve clamping the butt end of the shaft in place in a frequency analyzer and imparting a vibration to the tip end of the shaft as seen in FIG. 5. The resulting vibrations are optically measured by the analyzer to provide a reading of stiffness or vibration frequency. Frequency analyzers are well known to those skilled in the club making arts.

In the fitting process, the golfer is first taken to a driving range or other area where the golfer can hit golf balls using a progression of various clubs. The clubs utilized are calibrated test clubs and, for example, will include a selection of clubs as for example a 5, 7 and 9 iron having shafts with predetermined characteristics as for example each group of test clubs would have a vibration frequency of 300 cpm, another 295 cpm, and decreasing at increments of approximately 5 cpm to 260 cpm. The golfer will then be asked to hit a number of golf balls with a particular club. For example, a golfer may start with a 9 iron having a frequency of 300 cpm, which is considered a men's stiff club. The golfer will hit a number of balls with all or selected irons in this group and the results will be observed. The golfer's ball flight path and direction will be noted. If the golfer tends to repeatedly hit the golf ball to the left, this is an indication that the particular shaft selected is too stiff. If the golfer tends to repeatedly hit the golf to the right of the intended target line, this is an indication that the shaft is too flexible. Ball trajectory is also observed. A ball trajectory that is too flat indicates too stiff a club. Similarly, excessive loft may indicate a club shaft that is too flexible.

The fitting procedure continues with the golfer hitting the calibrated groups of test clubs working towards the optimum flex under the guidance of an experienced observer. Once the appropriate, or proper, flexure is reached, this will become apparent in the improved accuracy in ball flight. The golfer will then be requested to hit a number of shots with the irons in the group having the proper frequency to confirm the club selection. Once this has been determined, it will be noted and the fitting process can then be initiated. For purposes of illustration, it will be assumed that the golfer's test fitting indicates the ideal or optimum frequency for the golfer to be 300 cpm and that the golfer is of average size requiring standard length clubs.

This information is noted and provided to the golf club maker. The golf club maker will then select a blank shaft which is typically 41" in length. The shaft may be any material, but, in the case of the present illustration, it will be assumed that a conventional steel shaft, such as a shaft of the type manufactured by True Temper, will be used for the golf club. The butt end of the golf club will be clamped in the golf frequency analyzer and the tip end will be manually flexed and released. The vibration path is also observed and the club shaft rotated in the clamp until the vibration path is generally planar indicating the shaft spine location which is marked. This is shown in FIG. 5.

Figure 7:
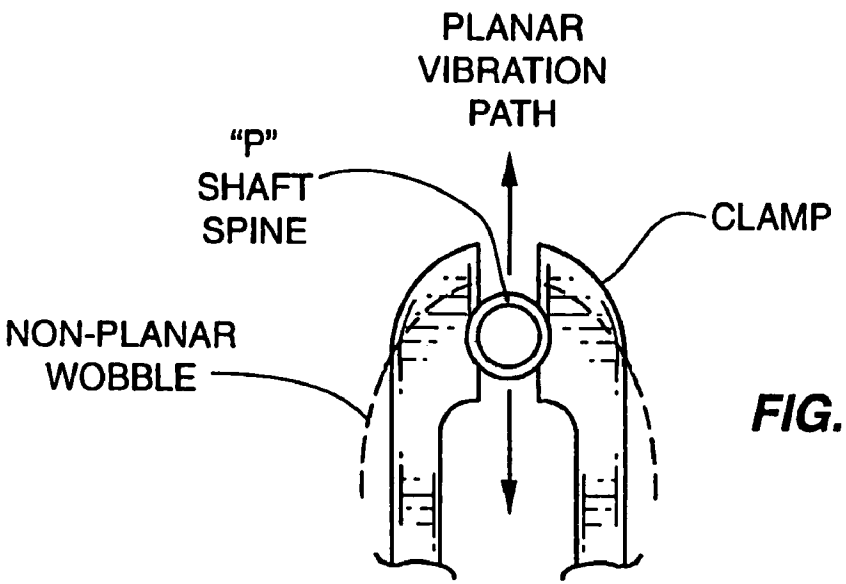
FIG. 7 illustrates the proper position of the shaft spine in the jaws of the clamp of a frequency analyzer as seen in FIG. 5.

In FIG. 5, a club shaft "S" is shown clamped at its butt end in a frequency analyzer. When the tip end is deflected and released, the shaft will vibrate at a rate or frequency dependent upon its length and stiffness. Shafts, both steel and composite, have a defined seam, sometimes termed a "spine" which runs longitudinally along the club shaft. For both consistency of frequency determination and optimum performance, it is desirable to first determine the location of the spine during testing. When the shaft is vibrating, it is observed. If the vibration is planar, that is, substantially up and down without wobble or oscillation, then the spine is aligned in the center between the jaws of the clamp at point P, as seen in FIG. 7. This location is then marked with a pen or other instrument. If the shaft vibration is not planar, or if there is wobble, then the fitter will rotate the shaft relative to the clamp until the proper vibration path is achieved.

Figure 6:
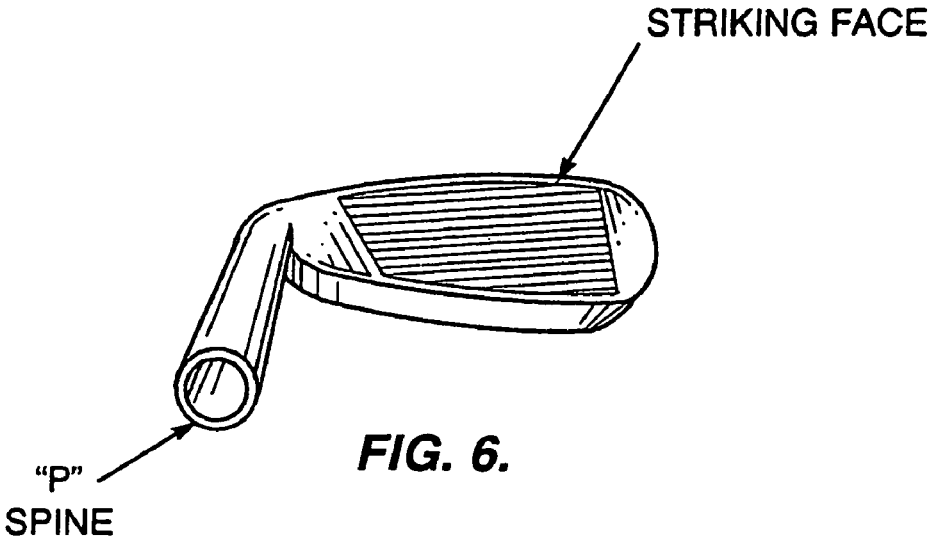
FIG. 6 illustrates the proper location of the shaft spine relative to the club head after assembly.
Figure 3A:
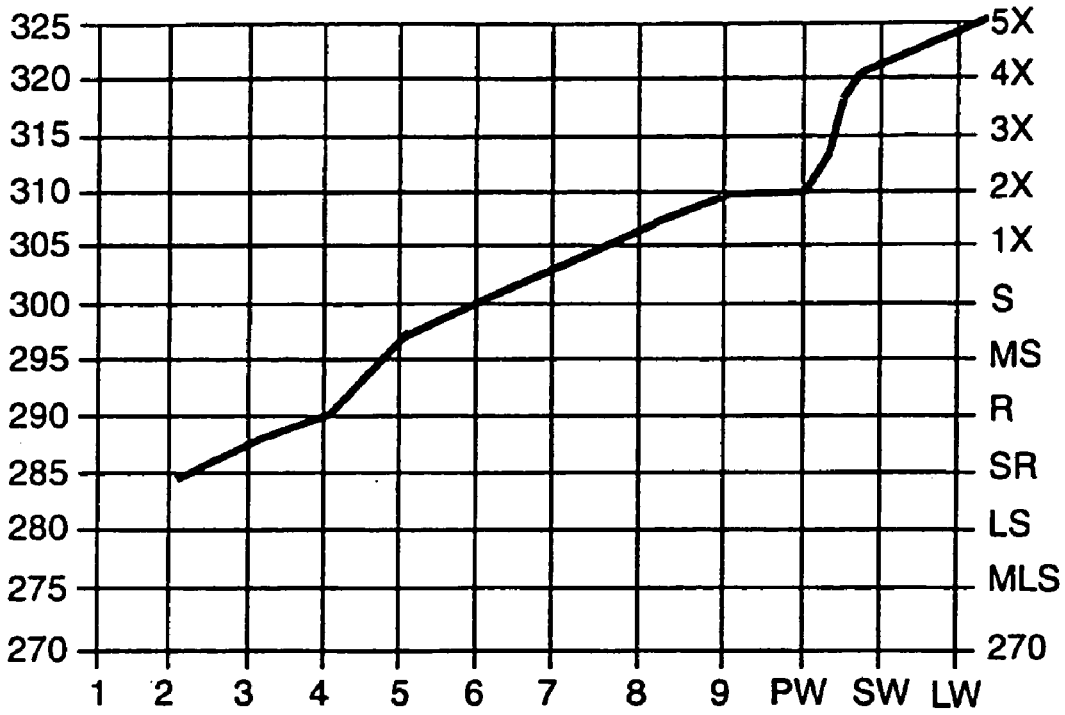
FIG. 3A illustrates the wide range of shaft stiffness that occurs with conventional mass-manufactured golf clubs.
Figure 3:
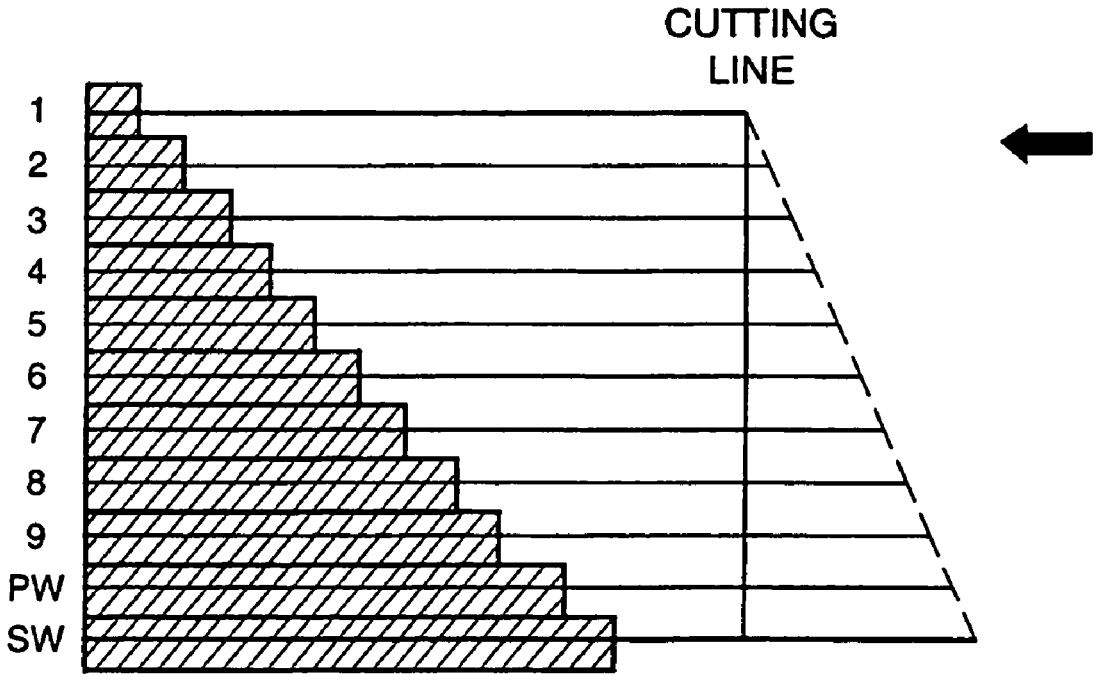
FIG. 3 is a chart illustrating the stiffness of conventional golf clubs.

Locating the spine also is important during final assembly of the shaft and club head. The club head should be positioned relative to the spine so the spine is opposite or behind the striking face as seen in FIG. 6. This position provides the optimum club performance as the rigid spine will more efficiently transmit the ball striking force from the shaft to the club head.

If, when the shaft is clamped, it is not properly oriented, a sensing device can be utilized to advise the maker that the shaft must be rotated. In FIG. 5, optical device D emits signals adjacent the shaft. If the vibration path is not substantially planar or up and down, the signals will be interrupted providing an indication that the shaft must be repositioned and the direction in which the shaft is to be rotated to position the spine in the location of FIG. 7. Optical devices which emit a signal and will determine deflection from a linear path are well known to those skilled in the art.

The golf club maker will then begin fitting the shaft for a particular club and, as for example a 9 iron. The fabrication process will begin by the maker trimming a portion of the butt end or the tip end in order to achieve a shaft with the desired frequency. Generally, trimming a ¼", or so, from the tip end will result in a frequency change of 1 cpm.

Much of the trimming operation depends upon the experience of the particular club maker. For a 9 iron, the resulting shaft should have a length of approximately 36.0". The maker will continue the trimming process trimming from either the tip or butt end of the club or both until the desired shaft length is reached having the desired characteristics. The maker must also keep in mind the weight and characteristics of the particular head and grip to be attached. Allowances must be made for the hosel insertion, generally a shaft prior to assembly must be measured to have a frequency response of 2 to 3 cpm below the desired finished product. The head and grip, once placed on the shaft, will also effect the stiffness and the following allowances are made for those. Once the shaft length has been trimmed to the desired length and has the required frequency characteristics, assembly of the club is completed by inserting the tip end of the shaft into the hosel and securing in place usually using an adhesive. The spine location was previously marked on the shaft and the head is positioned with the shaft spine opposite the club face. Thus, when the ball is struck, the spine is located behind the striking face for uniform flex. Similarly, the grip is adhesively secured to the butt end of the club.

The final step is to confirm that the assembled club has the desired frequency characteristics, as for example 300 cpm. Generally, iron club heads increase in weight as the number increases. For example, an 8 iron will generally be 6 or 7 grams heavier than a 7 iron. This increase in weight will be reflected in decreasing the shaft vibration frequency.

Once the club, as for example a 9 iron, has been completed, the procedure above is repeated with respect to the other irons in the set as for example 8 iron through the 3 iron which are the clubs customarily carried by most golfers. The same procedure applies to woods as well as irons.

The result is a set of clubs, either existing clubs which have been reshafted or modified or new clubs, that will flex at the same frequency, as shown in FIG. 4. The specific frequency selected for an individual player is determined through an empirical club fitting process based on a number of factors such as the particular golfer's ability, physical characteristics, size, club head speed and subjective factors such as feel. The resulting club is softer and its shaft vibrations are reduced. In most instances, a golfer using golf clubs fitted and fabricated in accordance with the present invention will experience instant improvement without any major swing changes. Golfers will gain additional distance, improve ball flight and more enjoyment of the game.

The foregoing describes a club fitting and fabrication process as would be performed by an individual golf club fitter or manufacturer. The present invention is also applicable to mass manufacture or fabrication of a large number of golf clubs. Mass golf club manufacturers will make hundreds of sets of golf clubs at a time having the same characteristics. Thus, a mass golf club manufacturer may wish to make a set of golf clubs all having matched frequency characteristics, for example men's regular clubs, which would have a conventional shaft length and have shafts that flex at the same frequency throughout the set, regardless of the particular club.

Figure 2:
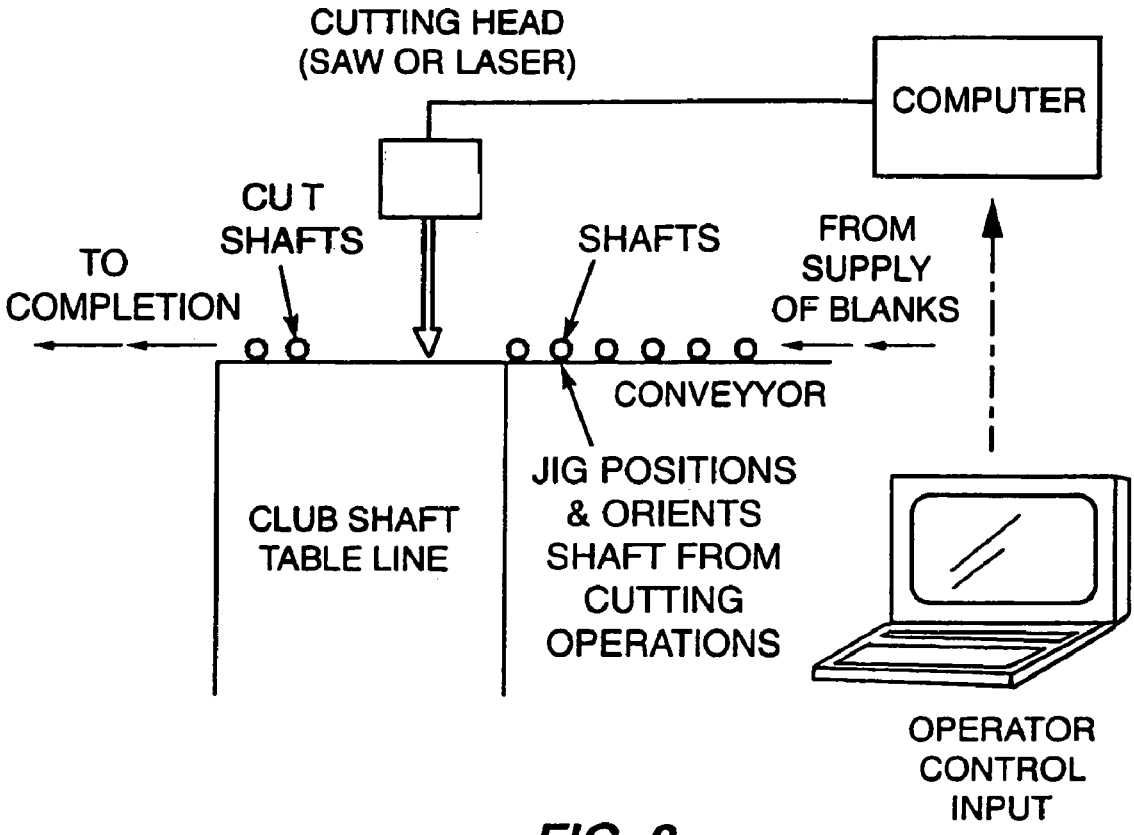
FIG. 2 is a schematic illustrating an automated method of making a set of golf clubs in accordance with the present invention.

Accordingly, referring to FIG. 2, a method of making a matched set of golf clubs having the same frequency can be automated. FIG. 2 shows a club shaft automated production line having a cutting head which is adapted to trim incremental lengths from either the butt or tip end of golf club shafts. The golf club blank shafts are advanced along the cutting line to the cutting head station. The sawing station is controlled by a computer. The computer has been loaded with software which includes the specific characteristics of the golf club shafts as well as those of various grips and golf club heads which may be applied to the shaft. These characteristics will include information such as the length of the shaft and the resulting stiffness which is achieved by cutting various incremental sections from either the butt or tip end or both. Also information such as the weight of various heads and the effect that various types of grips will have on the completed club. The program will compute the cutting operations to be performed to the shafts to result in a club having predetermined flex characteristics once completed with a grip and head.

Thus, the club manufacturer wishing to fabricate a large number of 9 irons all having the same flex, which will be matched with other irons having the same flex, will input the appropriate information into the computer. For example, the desired resulting final flex of the complete club will be entered along with identification of the particular head that will be attached to the shaft, as well as the grip. The head identification will not only include the number of the head, as for example 9 iron, but the style, as for example an oversized cavity-backed club head identified by model, which will allow the computer to use this information to calculate the precise incremental amount that will be required to be removed from either the butt end, tip end, or both, in order to produce the completed shaft from the raw blank. The blanks are advanced as by a conveyer and held stationary by a jig. The operators will then proceed to produce a desired number of shafts by appropriate cutting operations. The completed shafts can then be assembled to the golf club head and equipped with grips as is conventional. It is preferred that the spine location of each shaft has been located an identified so that the spine is positioned relative to the head as seen in FIG. 6.

The procedure can be completed for other clubs so that each operation, as for example 100 shafts can be manufactured for 9 irons, similarly 100 shafts for 8 irons and so on. Each of these then would be assembled with the appropriate head and grip and the result will be 100 mass manufactured golf club sets each having shafts of the desired specified flex.

This will provide the mass club manufacturer the ability to manufacture mass matched clubs heretofore generally only available on an individual basis from custom club fitters. The automated system also allows the mass manufacturer to vary the clubs putting different grips or club heads on the shaft as required.

From the foregoing, it will be seen that a golf club manufacturer can fabricate a frequency matched set of golf clubs, either on an individual basis or a mass manufacture basis, to provide a golfer a club that is reliable, dependable and one that has a "feel" consistent with the other clubs in the golfer's set.

It will be obvious to those skilled in the art to make various changes, alterations and modifications to the invention described herein. To the extent these various changes, alterations and modifications do not depart from the spirit and scope of the appended claims, they are intended to be encompassed therein.

I claim:

1. A method of fitting a golfer with a set of golf clubs all having shafts of substantially the same stiffness matched to the particular golfer;

(a) empirically determining the proper club shaft stiffness for a particular golfer by:

(i) providing a trained observer to observe the ball path and flight of the golf ball struck by the golfer;

(ii) having the observer watch the golfer strike a number of golf balls using a first group of test clubs in which the clubs in the group have varying lofts and all have substantially the same first shaft stiffness with the golfer progressing through the first group of clubs having the same shaft stiffness before testing subsequent club groups;

(iii) having the observer continuing to watch the golfer strike golf balls using one or more subsequent groups of test clubs in which the clubs in the group have varying lofts and all have substantially the same stiffness which stiffness is different than said first stiffness; and (iv) determining a selected stiffness for the particular golfer based on the observations of ball flight and path as the golfer strikes balls using the test clubs;

(b) fabricating a set of golf clubs all having substantially the selected stiffness by measuring the vibration frequency of a plurality of shaft blanks in a frequency analyzer by positioning the butt end of a shaft blank in a clamp and deflecting the tip end to achieve a generally planar vibration path to determine shaft frequency and to locate the shaft spine;

(c) incrementally trimming the blanks at an end as necessary to produce a set of shafts each having the desired length and all having substantially the same selected stiffness; and (d) securing a club head to each shaft with the spine location opposite the club head striking face.

2. The method of claim 1 further including the step of rotating the shaft relative to the clamp to establish a generally vibration path.

3. The method of claim 1 wherein the first stiffness is approximately 300 c.p.m.

4. The method of claim 1 wherein the first stiffness is at least 300 c.p.m. and the subsequent test clubs are less stiff.

5. The method of claim 1 wherein said spine location is noted and said spine is positioned generally opposite the club head face at assembly.

* * * * *